US011771135B2

(12) United States Patent
Biel et al.

(10) Patent No.: US 11,771,135 B2
(45) Date of Patent: Oct. 3, 2023

(54) ELECTRONIC SMOKING DEVICE WITH LIQUID RESERVOIR INCLUDING AN ACTUATOR

(71) Applicant: Fontem Holdings 1 B.V., Amsterdam (NL)

(72) Inventors: Stefan Biel, Hamburg (DE); Diego Gonzalez, Amsterdam (NL)

(73) Assignee: Fontem Ventures B.V., Amsterdam (NL)

( * ) Notice: Subject to any disclaimer, the term of this patent is extended or adjusted under 35 U.S.C. 154(b) by 455 days.

(21) Appl. No.: 16/943,967

(22) Filed: Jul. 30, 2020

(65) Prior Publication Data

US 2021/0007395 A1 Jan. 14, 2021

Related U.S. Application Data

(63) Continuation of application No. 16/792,673, filed on Feb. 17, 2020, now Pat. No. 10,729,174, which is a continuation of application No. 15/563,881, filed as application No. PCT/EP2016/056939 on Mar. 30, 2016, now Pat. No. 10,595,564.

(30) Foreign Application Priority Data

Apr. 2, 2015 (EP) ..... 15162407

(51) Int. Cl.

| | |
|---|---|
| ***A24F 40/40*** | (2020.01) |
| ***A24F 40/42*** | (2020.01) |
| ***A24F 40/50*** | (2020.01) |
| ***A24F 40/48*** | (2020.01) |

(Continued)

(52) U.S. Cl.

CPC ..... *A24F 40/50* (2020.01); *A24F 40/40* (2020.01); *A24F 40/42* (2020.01); *A24F 40/48* (2020.01); *A24F 40/485* (2020.01); *A24F 40/10* (2020.01)

(58) Field of Classification Search

CPC ..... A24F 40/40; A24F 40/42; A24F 40/46; A24F 40/48; A24F 40/51

See application file for complete search history.

(56) References Cited

U.S. PATENT DOCUMENTS

| | | | |
|---|---|---|---|
| 4,393,884 | A | 7/1983 | Jacobs |
| 4,911,181 | A | 3/1990 | Vromen et al. |

(Continued)

FOREIGN PATENT DOCUMENTS

| | | | |
|---|---|---|---|
| EP | 3075271 | A1 | 10/2016 |
| GB | 2536978 | A | 10/2016 |

(Continued)

*Primary Examiner* — Hae Moon Hyeon

(74) *Attorney, Agent, or Firm* — Dykema Gossett PLLC

(57) ABSTRACT

An electronic smoking device includes a battery portion including an electric power supply, an atomizer/liquid reservoir portion having a mouthpiece opening in an end, and a liquid reservoir adapted for accommodating a liquid. The electronic smoking device further includes an atomizer arranged at a first end face of the liquid reservoir and operable when connected to the power supply to atomize liquid to create an aerosol, wherein the atomizer comprises a plurality of openings adapted for providing the aerosol, and an actuator movable inside the liquid reservoir towards the first end face and adapted for supplying liquid to the plurality of openings.

18 Claims, 3 Drawing Sheets

(51) Int. Cl.
*A24F 40/485* (2020.01)
*A24F 40/10* (2020.01)

(56) References Cited

U.S. PATENT DOCUMENTS

| | | | | |
|---|---|---|---|---|
| 10,321,713 | B2 | 6/2019 | Hopps et al. | |
| 10,595,564 | B2 * | 3/2020 | Biel | A24F 40/42 |
| 10,729,174 | B2 * | 8/2020 | Biel | A24F 40/42 |
| 2005/0016550 | A1 | 1/2005 | Katase | |
| 2014/0338680 | A1 | 11/2014 | Abramov et al. | |
| 2015/0027470 | A1 | 1/2015 | Kane et al. | |
| 2016/0021931 | A1 | 1/2016 | Hawes et al. | |
| 2016/0309783 | A1 | 10/2016 | Hopps et al. | |
| 2016/0331033 | A1 | 11/2016 | Hoops et al. | |
| 2017/0231277 | A1 | 8/2017 | Mironov et al. | |
| 2018/0110263 | A1 | 4/2018 | Borkovec et al. | |

FOREIGN PATENT DOCUMENTS

| | | | | |
|---|---|---|---|---|
| WO | 2013/089358 | A1 | 6/2013 | |
| WO | 2014/079024 | A1 | 5/2014 | |
| WO | 2014/153515 | A1 | 9/2014 | |
| WO | WO-2015117700 | A1 * | 8/2015 | A24B 15/16 |

* cited by examiner

ELECTRONIC SMOKING DEVICE WITH LIQUID RESERVOIR INCLUDING AN ACTUATOR

CROSS-REFERENCE TO RELATED APPLICATIONS

This application is a continuation of U.S. application Ser. No. 16/792,673, filed 17 Feb. 2020 (the '673 application); which is a continuation of U.S. application Ser. No. 15/563,881, filed 2 Oct. 2017 (the '881 application), which is the national stage of international application no. PCT/EP2016/056939, filed 30 Mar. 2016 and published in English 6 Oct. 2016 under international publication no. WO2016/156413 (the '939 application), which claims priority to European application no. 15162407.9, filed 2 Apr. 2015 (the '407 application). The '673 application; the '881 application; the '939 application; and, the '407 application are all hereby incorporated by reference in their entirety as though fully set forth herein.

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

Currently most e-cigarettes in the market have a wick whose function is to transport liquid from a liquid reservoir to the heating element. This wick has a number of issues: Often, the liquid is not transported fast enough to the heating element, which causes the temperature in the heating element to rise above 200-220 degrees which can lead to an increase of by-products; the rise of temperature also causes liquid particles to deposit and to attach to the heating element which over time builds residues around the heating element that cause the flavor to be altered. In systems in which the atomizer and the liquid reservoir are not coupled the wick will always contain liquid when the liquid container is replaced. If the e-liquid flavor in the liquid container is changed, flavor will be mixed in the wick until all of the previous e-liquid flavor is consumed, hence there will be number of puffs in which a crossover of flavors exists. Further, the particle size may be difficult to control.

SUMMARY OF THE INVENTION

In accordance with one aspect of the present invention there is provided an electronic smoking device has a battery portion including an electric power supply, an atomizer/liquid reservoir portion having a mouthpiece opening in an end, and a liquid reservoir adapted for accommodating a liquid. The electronic smoking device further includes an atomizer arranged at a first end face of the liquid reservoir and operable when connected to the power supply to atomize liquid to create an aerosol, wherein the atomizer comprises a plurality of openings adapted for providing the aerosol and an actuator movable inside the liquid reservoir towards the first end face and adapted for supplying liquid to the plurality of openings.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
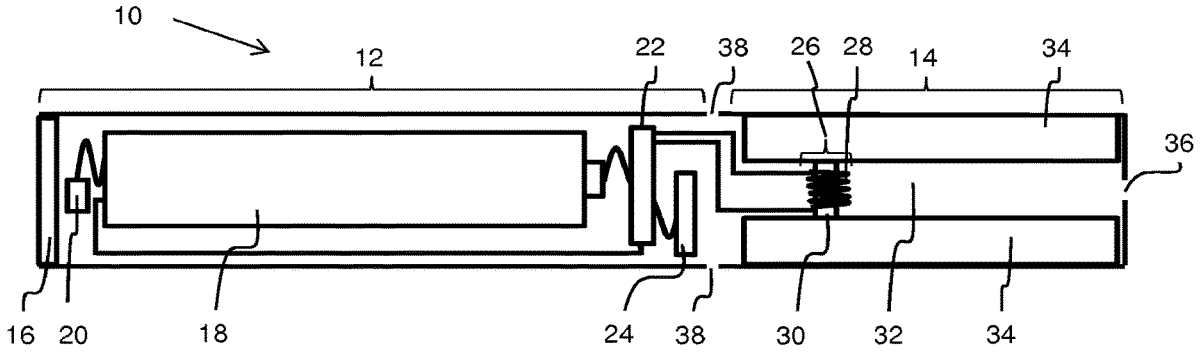
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be single piece or a multiple piece tube. In FIG. 1, the cylindrical hollow tube is shown as a two piece structure having a battery portion 12 and an atomizer/liquid reservoir portion 14. Together the battery portion 12 and the atomizer/liquid reservoir portion 14 form a cylindrical tube which is approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of steel or hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light emitting diode (LED) 20 positioned near the end cap to emit light through the end cap. The end cap can be made of metal or other materials that do not allow light to pass.

An air inlet may be provided in the end cap, at the edge of the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, the LED 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at another end of the battery portion 12 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure such a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to a liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or may be formed in another end cap located at the back end of the atomizer/liquid reservoir portion 14.

In use, a user sucks on the e-cigarette 10 through the air inhalation port 36. This causes air to be drawn into the e-cigarette 10 via one or more air inlets, such as air inlets 38 and to be drawn through the central passage 32 towards the air inhalation port 36. The change in air pressure which arises is detected by the airflow sensor 24 which generates an electrical signal that is passed to the control electronics 22. In response to the signal, the control electronics 22 activate the heating coil 28 which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34 after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer. The atomizer/liquid reservoir portion may represent a cartomizer 14.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
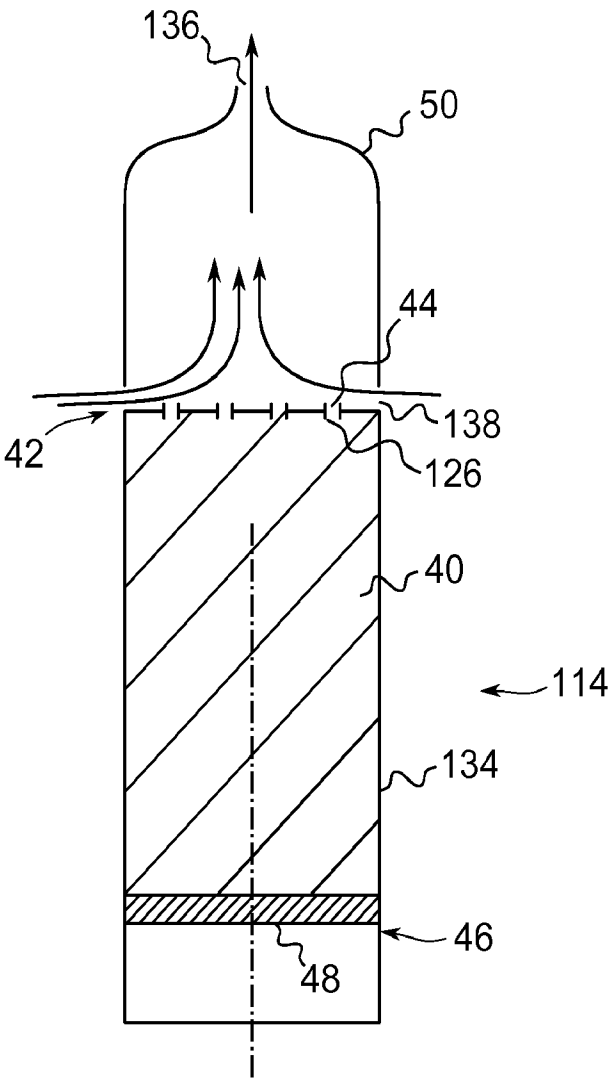
FIG. 2 is a schematic cross-sectional illustration of an exemplary cartomizer including a liquid reservoir and an atomizer.

FIG. 2 shows an exemplary sectional view of an atomizer/liquid reservoir portion or cartomizer 114. The cartomizer 114 shown in FIG. 2 corresponds to the atomizer/liquid reservoir portion 14 shown in FIG. 1. The cartomizer 114 is adapted to replace the atomizer/liquid reservoir portion 14.

The cartomizer 114 or the electronic smoking device includes a liquid reservoir 134 adapted for accommodating a liquid 40 or a solid e-liquid wax. The atomizer 126 is arranged at a first end face 42 of the liquid reservoir 134. The liquid reservoir 134 has an elongated form with a main axis A. The atomizer 126 is arranged perpendicular to the main axis A. The atomizer 126 comprises a plurality of openings 44. The openings 44 are arranged in parallel to the main axis A. The openings 44 are providing passages from an inside of the liquid reservoir 134 to the exterior of the liquid reservoir 134.

The electronic smoking device of the embodiment shown in FIG. 2 further includes an actuator 46 which is moveable inside the liquid reservoir 134 towards the first end face 42. According to the embodiment shown in FIG. 2 the actuator 46 includes a piston 48 which is activated mechanically or electrically. The actuator 46 or the piston 48 is adapted for supplying liquid 40 to the plurality of openings 44. The liquid 40 is supplied or pressed by the piston 48 until it reaches the atomizer 126, reaches into the plurality of openings 44 or passes through the openings 44.

When the atomizer 126 is connected to a power supply, the atomizer 126 or parts of the atomizer 126 heat up and atomize or vaporize the liquid 40 to create an aerosol. At least one of the liquid 40 and the aerosol is provided by the plurality of openings 44 to the exterior of the liquid reservoir 134.

At least one air inlet 138 is provided at an edge of the atomizer 126 opposed to the liquid reservoir 134. The air inlets 138 are located at an edge of the atomizer 126 and of the liquid reservoir 134 which lies radially outwards with respect to the main axis A. The air inlets 138 are located in an axial direction between the liquid reservoir 134 and a mouthpiece portion 50 of the electronic cigarette 10. The air inlets 138 are formed within at least one of the mouthpiece portion 50 and the atomizer 126. The air inlets 138 may also be defined as a gap between the mouthpiece portion 50 and the atomizer 126. The air inlet 138 connects the outside of the cartomizer 114 with its interior. In particular, ambient air is provided through the at least one air inlet 138 to the atomizer 126.

The size of the at least one air inlet 138 may be changed for example by a sleeve rotating or moving axially and thereby aligning its holes with the ones on the housing. By doing so, the draw resistance may be tuned based on whether a deep inhalation or "recreational" puffing is desired.

The air inhalation port 136 is located in the far end of the mouthpiece portion 50 in relation to the liquid reservoir 134. Such arrangement allows airflow from the air inlets to the air inhalation port 136 which passes at least in part the atomizer 126 and the plurality of openings 44. This implies that droplets or an aerosol which exits through the plurality of openings 44 is mixed with ambient air drawn through the air inlets 138. The distance between the air inhalation port 136 and the atomizer 126 may be chosen such that the formation of turbulent airflow is prevented which otherwise limits the condensation on inside surfaces of the cartomizer 114.

Since there is no wick the liquid is supplied to the atomizer 126 in a continuous and fast manner. The plurality of openings 44 lets the vaporized liquid leave the surface of the atomizer 126 without the atomizer 126 being a bottleneck for the created aerosol. The control of the liquid flow may be moved to the actuator 46. The movement of the actuator 46 may be electronically controlled based on an optional airflow sensor 24 or a button. The combination of the atomizer 126 including the plurality of openings 44 and the actuator 46 may have the advantage of reducing the amount of unused liquid remaining inside the liquid reservoir 134. The embodiment of the present invention may also have the advantage of reducing the crossover between previously used flavors and the current flavor, since there is no overage liquid. The vaporization byproducts and taste degradation of the system are also greatly reduced since the flow of liquid is very tightly controlled.

The liquid 40 may be based on propylene-glycol (PG). The liquid may further include at least one of glycerol, water, nicotine and natural or synthetic flavor extracts. In addition, flavored materials may be added to the liquid, for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavored materials as mentioned above into new flavored materials. Moreover, it is possible to adsorb any flavor onto a solid material and to use this material as flavored material within an electronic smoking device according to the present invention.

The size or the diameter of the openings 44 may be a function of the liquid's viscosity and the vaporization rate. The vaporization rate influences along with the liquid formulation the particle size of the generated aerosol. At least one of the size and the shape of the openings 44 may be adapted to the viscosity of the liquid 40 so that no leakage of the liquid 40 out of the liquid reservoir 134 occurs at least unless the actuator 46 is actuated. In other words, liquid 40 can only leave the liquid reservoir 134 when the actuator 46 is actuated. The atomizer 126 may be integrally formed with the liquid reservoir 134. In such case the atomizer 126 and the liquid reservoir 134 form a single unit. This single unit may be used as a cartridge for a refillable electronic cigarette.

The atomizer 126 may completely cover the first end face 42 of the liquid reservoir 134. In such an embodiment the atomizer 126 may replace a sidewall of the liquid reservoir. The liquid reservoir may have a cylindrical or rectangular form. The first end face 42 accordingly may have a circular or rectangular shape.

Figure 4:
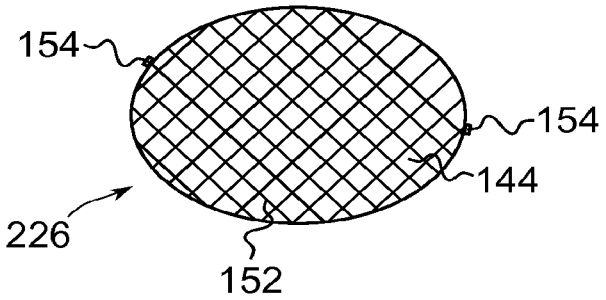
FIG. 4 is a schematic top view of an exemplary atomizer.
Figure 5:
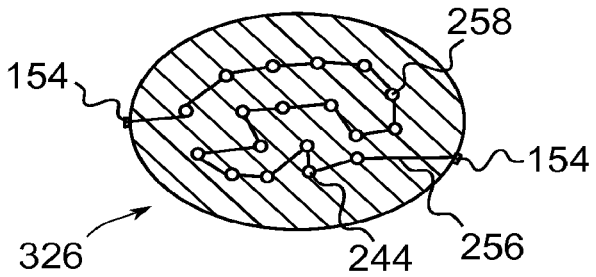
FIG. 5 is a schematic top view of a further exemplary atomizer.

The plurality of openings 44 may be distributed evenly or unevenly over the first end face 42. Walls of the openings 44 may comprise electrical conducting material and the walls may be electrically connected to the power supply 18 using one or more contact portions (e.g., contact portion 154 as depicted in FIGS. 4 and 5). Such an embodiment may have the advantage that the openings 44 are heated so that liquid 40 is vaporized in direct vicinity of the openings 44 where the created aerosol or droplets are leaving the liquid reservoir 134 through the plurality of openings 44. The first end face 42, the atomizer 126 and/or the liquid reservoir 134 may be electrically insulated against the exterior of the e-cigarette 10 for example by a housing of the e-cigarette 10 or the cartomizer 114.

The actuator 46 may be controlled such that it keeps its actual position when not being actuated. This implies that the actuator 46 or the piston 48 remains in its last position and is not returning to an initial position far from the atomizer 126. This may have the advantage that liquid 40 is always present at the atomizer 126 and at the plurality of openings 44. The speed at which the actuator 46 of the piston 48 moves may be a function of the desired or determined vaporization rate or of a detected under pressure, i.e. a force at which a consumer puffs. This may ensure that sufficient liquid 40 is present at the plurality of openings 44 in order to maintain the defined percentage of vaporized liquid inside the airflow leaving the air inhalation port 146.

Figure 3:
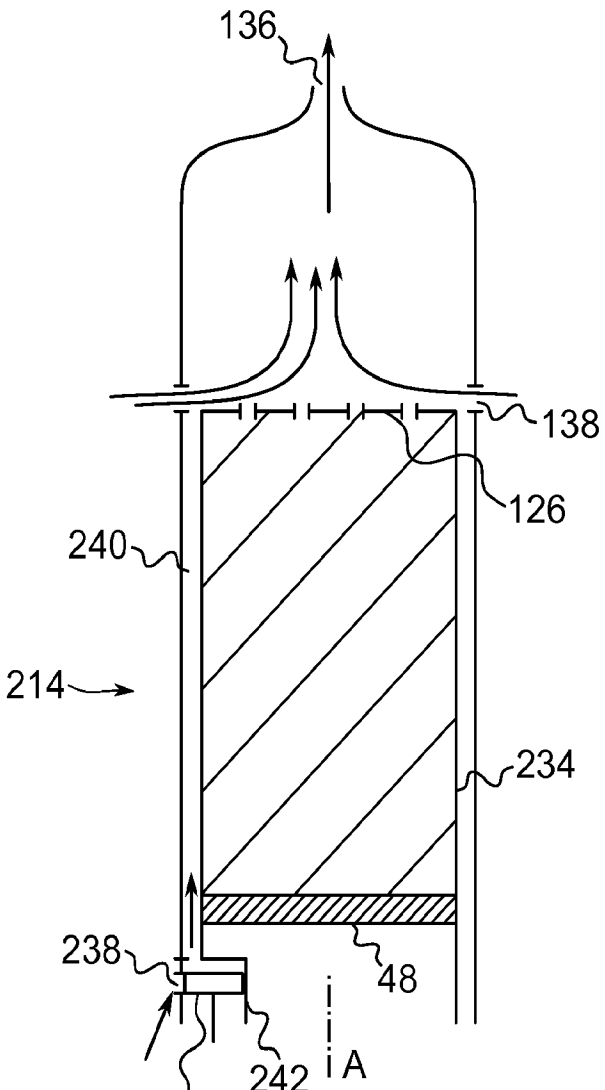
FIG. 3 is a schematic cross-sectional illustration of a further exemplary cartomizer including an airflow sensor.

FIG. 3 shows an exemplary sectional view of an atomizer/liquid reservoir portion or cartomizer 214 including a puff detector or airflow sensor 124. The airflow sensor 124 is arranged at a side or underneath (with regard to the axis A) the liquid reservoir 234. An additional air inlet 238 is provided in the shell or housing of the cartomizer 214 and is in fluid connection with the airflow sensor 124. A passageway 240 for drawn air extends from the additional air inlet 238 or the airflow sensor 124 to at least one of the air inlets 138 and further towards the air inhalation port 136. When air is drawn through the air inhalation port 136 ambient air enters the cartomizer 214 through the additional air inlet 238 into the airflow sensor 124. Then, the airflow sensor 124 detects the flow of air and provides a signal to a control unit. The airflow sensor 124 and the atomizer 126 are connected to the battery by wirings 242 for providing energy. Signals may also be transmitted via the wirings 242.

FIG. 4 shows an exemplary embodiment of an atomizer 226. The atomizer 226 is shown in a top view illustration. The atomizer 226 includes a mesh 152. The mesh 152 is formed of or includes electrical conducting material like for example wires or rods. A plurality of openings 144 is formed by the mesh 152. The openings 144 have a rectangular or square cross section.

The atomizer 226 further includes electric contact portions 154 adapted to be connected to the power supply 18 of the electronic cigarette 10. The two or more contact portions 154 are electrically connected with the mesh 152 so that a current flows through the mesh, i.e. through the wires or rods of the mesh 152. The mesh 152 is heated by the current in order to vaporize liquid 40 being placed at the atomizer 226. The contact portions 154 may be provided locally having a small extension like shown in FIG. 4. As an alternative larger contact portions may be provided covering a larger extend of the outer edge of the atomizer 226. One of the larger contact portions may cover up to half of the outer edge of the atomizer 226.

Such mesh 152 may have the advantage of easy production and increased opening for the liquid to pass through the atomizer 226. Instead of mesh 152 a surface with a plurality of perforations or small holes may be provided.

FIG. 5 shows a top view of further embodiment of an atomizer 326. The atomizer 326 includes a plate in which a plurality of openings 244 is arranged. One or more electrical conductors 256 connect the two contact portions 154 and walls 258 of the openings 244 in a serial manner. This arrangement allows for an electrical current flow between the two contact portions 154 thereby heating the walls 258 of all openings 244. At least one of the metalized walls 258 and the conductor 256 acts as a heating element for vaporizing the liquid 40. The atomizer 326 may be realized by using printed circuit board technology in which the holes are pass-through vias, the vias may be made of Ni—Cr alloy, Kanthal or other similar alloys.

Figure 6:
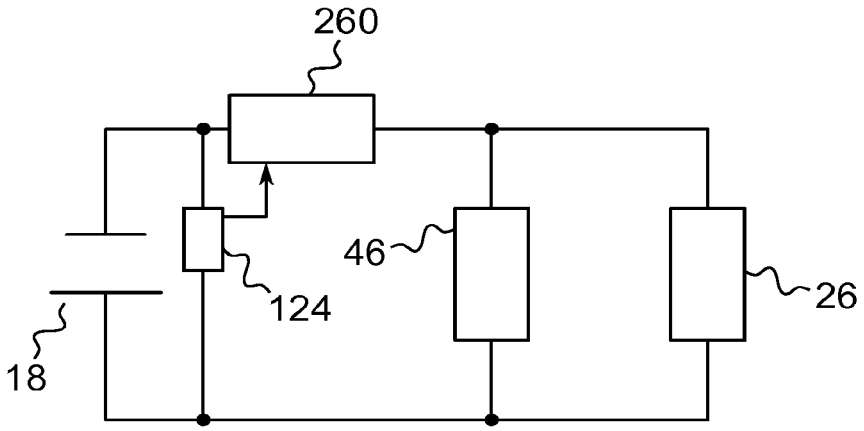
FIG. 6 is an exemplary wiring diagram of the cartomizer.

FIG. 6 shows an exemplary wiring diagram of an embodiment of the present invention. The battery 18 of the e-cigarette 10 is connected to a control unit 260. The control unit 260 is serially connected with the battery 18. The battery 18 powers the control unit 260. The control unit 260 acts as a switch for connecting and disconnecting the battery besides further functions. The atomizer 26 and the actuator 46 are connected in parallel to the battery 18. The control unit 260 is adapted to activate the atomizer 26 and the actuator 46. The control unit 260 activates the atomizer 26 and the actuator 46 when the airflow sensor 124 or a button is activated. The airflow sensor 124 is powered by the battery 18 and its output is connected to an input of the control unit 260 so as to deliver a signal indicating activation of the e-cigarette 10.

When the control unit 260 activates the atomizer 26 or its heating element, i.e. the mesh 152, the openings 44, the walls 258 and/or the conductor 256 vaporizes the liquid 40. When the actuator 46 is activated it moves along the main axis A towards the atomizer 26 thereby conveying liquid 40 towards the atomizer 26. The atomizer 26 and the actuator 46 may be activated independently or in parallel. A level or degree of activation may be controlled by the respective current value which is fed to the atomizer 26 and the actuator 46, respectively. A higher current increases the heat at the atomizer 26 and an increased current leads to a higher velocity of the actuator 46. Depending on properties of the liquid 40 like for example its viscosity and/or the size and number of the openings 44 the current values for the actuator 46 and the atomizer 26 may be calculated by the control unit 260.

In summary, in one aspect the electronic smoking device has a battery portion including an electric power supply, an atomizer/liquid reservoir portion having a mouthpiece opening in an end, and a liquid reservoir adapted for accommodating a liquid. The electronic smoking device further includes an atomizer arranged at a first end face of the liquid reservoir and operable when connected to the power supply to atomize liquid to create an aerosol, wherein the atomizer comprises a plurality of openings adapted for providing the aerosol and an actuator movable inside the liquid reservoir towards the first end face and adapted for supplying liquid to the plurality of openings. The combination of the plurality of openings and the actuator may have the advantage of allowing steady and adequate liquid supply to the atomizer.

Walls of the openings may comprise electrical conducting material, wherein the walls may be electrically connected with contact portions adapted to be connected to the power supply. The walls are directly adjoining the holes so that liquid is heated directly at the holes. Such arrangement may have the advantage of better aerosol production and delivery.

The atomizer may comprise a mesh. A mesh is an easy way of providing a plurality of openings. If desired, a mesh may provide evenly distributed openings.

The atomizer may comprise a printed circuit board with openings having metallized walls. Such a design may be easy and inexpensive to produce.

The size of the openings may be a function of the liquid's viscosity and the vaporization rate.

The atomizer may be integrally formed with the liquid reservoir. This may allow easy handling and allow providing it as a single unit.

The atomizer may completely cover the first end face of the liquid reservoir. This may maximize the cross section for delivering liquid or aerosol.

At least one air inlet may be provided at an edge of the atomizer opposed to the liquid reservoir. The air inlets may be arranged equidistantly along the edge to improve mixing of the aerosol with ambient air entering through the air inlet.

The liquid may be based on propylene-glycol (PG). A liquid mainly based on PG, i.e. including at least 75 percent of PG, has good properties for being utilized by the actuator and the plurality of openings.

The liquid may include at least one of glycerol, water, nicotine and natural extracts. These further ingredients may improve the smoking experience.

The actuator may comprise a piston which may be controlled by an airflow sensor or a button. Such control may guarantee liquid delivery to the atomizer adapted to the consumption of the liquid.

The actuator may be controlled such that it keeps its actual position when not being actuated. This embodiment may have the advantage that liquid is always present at the atomizer. Further, liquid may be present at a same pressure. A further advantage may be that spitting or uneven aerosol delivery is avoided.

The actuator and the atomizer may be electrically connected in parallel with the power supply so that they are activated in parallel. As an alternative, the actuator and the atomizer may each be electrically connected to a control unit which activates both units preferably in parallel.

In one aspect the cartomizer operable to be connected to a power supply for an electronic smoking device includes a liquid reservoir adapted for accommodating a liquid, an atomizer arranged at a first end face of the liquid reservoir and operable when connected to a power supply to atomize liquid to create an aerosol, wherein the atomizer comprises a plurality of openings adapted for providing the aerosol, and an actuator movable inside the liquid reservoir towards the first end face and adapted for supplying liquid to the plurality of openings. The same advantages and modifications described above apply.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 e-cigarette
12 battery portion
14, 114, 214 atomizer/liquid reservoir portion
16 end cap
18 battery
20 light emitting diode (LED)
22 control electronics
24, 124 airflow sensor
26, 126, 226, 326 atomizer
28 heating coil
30 wick
32 central passage
34, 134, 234 liquid reservoir
36, 136 air inhalation port
38, 138 air inlets
40 liquid
42 end face
44, 144, 244 opening
46 actuator
48 piston
50 mouthpiece portion
152 mesh
154 contact portion
238 air inlet
240 passageway
242 wirings
256 conductor
258 wall
260 control unit
A axis

The invention claimed is:

1. An electronic smoking device comprising:

a battery portion including an electric power supply; and an atomizer/liquid reservoir portion having a mouthpiece in an end, the atomizer/liquid reservoir portion including:

a liquid reservoir adapted for accommodating a liquid; and an atomizer arranged at a first end face of the liquid reservoir and operable when connected to the power supply to atomize the liquid for creating an aerosol, wherein the atomizer includes a mesh having a plurality of openings defining a plurality of respective passages from an inside of the liquid reservoir to the exterior of the liquid reservoir, the plurality of openings adapted for providing the aerosol to the mouthpiece, wherein the plurality of respective openings are sized to prevent a liquid fluid flow across through the plurality of passages from the inside of the liquid reservoir to the exterior of the liquid reservoir, and wherein the plurality of openings are sized to allow for the aerosol to pass through the plurality of passages.

2. The electronic smoking device of claim 1, wherein the mesh is electrically connected to a contact portion, the contact portion configured for electrical connection to the power supply.

3. The electronic smoking device of claim 1, wherein a size of the plurality of openings are a function of a viscosity of the liquid and a vaporization rate of the liquid by the atomizer.

4. The electronic smoking device of claim 1, wherein the atomizer is integrally formed with the liquid reservoir.

5. The electronic smoking device of claim 1, wherein the atomizer completely covers the first end face of the liquid reservoir.

6. The electronic smoking device of claim 1, wherein at least one air inlet is located at an edge of the atomizer opposed to the liquid reservoir.

7. The electronic smoking device of claim 1, wherein the liquid is based on propylene-glycol.

8. The electronic smoking device of claim 1, wherein the liquid includes at least one of glycerol, water, nicotine, and natural extracts.

9. The electronic smoking device of claim 1, further comprising an actuator movable inside the liquid reservoir, the actuator adapted to supply the liquid to the plurality of openings, when the actuator is moved towards the first end face.

10. The electronic smoking device of claim 9, wherein the actuator comprises a piston controllable by an airflow sensor or a button.

11. The electronic smoking device of claim 9, wherein the actuator is configured to be controlled to maintain position when not being actuated.

12. The electronic smoking device of claim 9, wherein the actuator and the atomizer are electrically connected in parallel with the power supply.

13. A cartomizer operable to be connected to a power supply for an electronic smoking device, the cartomizer comprising:

a liquid reservoir adapted for accommodating a liquid; and an atomizer arranged at a first end face of the liquid reservoir and operable when connected to the power supply to atomize the liquid for creating an aerosol, wherein the atomizer includes a mesh having a plurality of openings defining a plurality of respective passages from an inside of the liquid reservoir to the exterior of the liquid reservoir, the plurality of openings adapted for providing the aerosol to a mouthpiece of the electronic smoking device, wherein the plurality of openings are sized to prevent the liquid from flowing through the plurality of passages, and wherein the plurality of openings are sized to allow the aerosol to pass through the plurality of passages.

14. The cartomizer of claim 13, wherein the mesh is electrically connected to a contact portion, the contact portion configured for electrical connection with the power supply.

15. The cartomizer of claim 13, wherein a size of the plurality of openings are a function of a viscosity of the liquid and a vaporization rate of the liquid by the atomizer.

16. The cartomizer of claim 13, further comprising an actuator movable inside the liquid reservoir, the actuator adapted to supply the liquid to the plurality of openings, when the actuator is moved towards the first end face.

17. The cartomizer of claim 13, wherein the actuator comprises a piston controllable by an airflow sensor or a button.

18. The cartomizer of claim 17, wherein the actuator is configured to be controlled such that the actuator keeps the actuator's actual position when not being actuated.

* * * * *